US008162528B2

(12) United States Patent
Dressel et al.

(10) Patent No.: US 8,162,528 B2
(45) Date of Patent: Apr. 24, 2012

(54) LAMP BASE

(75) Inventors: Karin Dressel, Berlin (DE); Matthias Protsch, Berlin (DE); Thomas Schmidt-Lehmann, Hong Kong (CN)

(73) Assignee: Osram AG, Munich (DE)

( * ) Notice: Subject to any disclaimer, the term of this patent is extended or adjusted under 35 U.S.C. 154(b) by 458 days.

(21) Appl. No.: 12/310,665

(22) PCT Filed: Aug. 17, 2007

(86) PCT No.: PCT/EP2007/058581
§ 371 (c)(1),
(2), (4) Date: Mar. 2, 2009

(87) PCT Pub. No.: WO2008/028795
PCT Pub. Date: Mar. 13, 2008

(65) Prior Publication Data

US 2010/0176709 A1 Jul. 15, 2010

(30) Foreign Application Priority Data

Sep. 8, 2006 (DE) ..... 10 2006 042 178

(51) Int. Cl.
*H01R 33/00* (2006.01)
*H01R 13/213* (2006.01)

(52) U.S. Cl. ..... 362/651; 439/314

(58) Field of Classification Search ..... 362/651; 439/314, 332, 336, 616; 264/108
See application file for complete search history.

(56) References Cited

U.S. PATENT DOCUMENTS

| | | | | |
|---|---|---|---|---|
| 4,358,176 | A * | 11/1982 | Arnold et al. | 439/332 |
| 4,789,920 | A | 12/1988 | Helbig et al. | |
| 4,909,690 | A * | 3/1990 | Gapp et al. | 411/411 |
| 5,093,050 | A * | 3/1992 | Tepic | 264/415 |
| 5,361,483 | A * | 11/1994 | Rainville et al. | 29/524.1 |
| 6,284,831 | B1 * | 9/2001 | Shimpuku et al. | 524/494 |
| 7,275,855 | B2 | 10/2007 | Protsch et al. | |
| 2004/0090793 | A1 * | 5/2004 | Morsing | 362/551 |

FOREIGN PATENT DOCUMENTS

| | | | |
|---|---|---|---|
| CH | 565055 | A * | 8/1975 |
| EP | 1 605 490 | A2 | 5/2005 |
| EP | 1 605 490 | A3 | 5/2005 |

* cited by examiner

*Primary Examiner* — Alan Cariaso
(74) *Attorney, Agent, or Firm* — Holtz, Holtz, Goodman & Chick, PC

(57) ABSTRACT

The invention relates to a lamp base (2), in particular a lamp base for a vehicle lamp, the lamp base having a plastic base part (20) with at least one molded stub (21), wherein the plastics material of the plastic base part is mixed with reinforcing fibers (4), the orientation of which in the stub has a preferential direction. This allows the mechanical load-bearing capacity of the stubs to be advantageously increased.

9 Claims, 8 Drawing Sheets

LAMP BASE

Figure 1A:
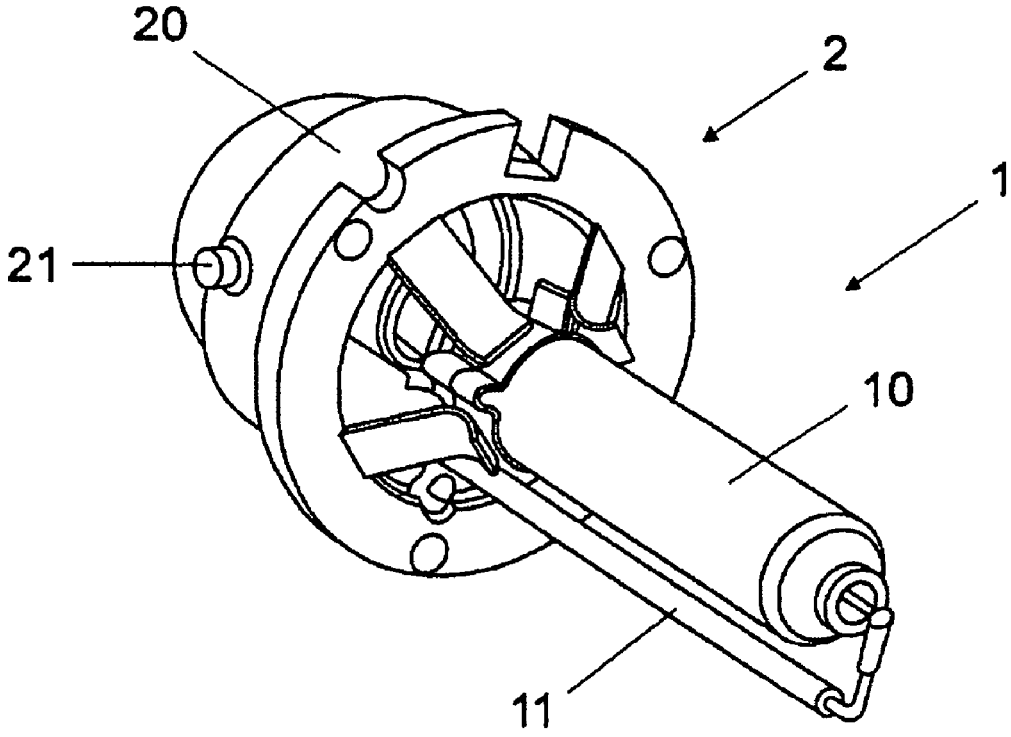

This application is a U.S. National Phase Application under 35 USC 371 of International Application PCT/EP2007/058581, filed Aug. 17, 2007, which is incorporated herein in its entirety by this reference.

The invention relates to a lamp base for a lamp, in particular a vehicle lamp, and to a method for manufacturing such a lamp base.

A vehicle lamp is disclosed, for example, in the European laid-open specification EP 0 786 791 A1. This vehicle lamp has a lamp base made from plastic, with two diametrically arranged, radially outwardly pointing studs being formed on the lamp base. These studs are used as part of a locking mechanism, in particular a bayonet-type closure, and therefore need to withstand high mechanical loads. Studs breaking off, as may occur in conventional lamp bases given insufficient stud strength, disadvantageously results in failure of the lamp.

One object of the present invention is to specify a lamp base in which the stud strength is increased. Furthermore, a method is specified with which such a lamp base can be manufactured in a simplified manner.

This object is achieved by a lamp base having the features of patent claim 1 or by a method having the features of patent claim 22. Advantageous configurations and developments of the invention are the subject matter of the dependent patent claims.

A lamp base according to the invention has a plastic base part with at least one shaped-out stud, the plastics material of the plastic base part being mixed with reinforcing fibers, and the orientation of the reinforcing fibers in the stud having a preferential direction.

It has been shown that the stud strength, in particular in comparison with a stud with unoriented fibers, can advantageously be increased by means of the reinforcing fibers, whose orientation in the stud has a preferential direction.

In a preferred configuration, the plastic base part has a further shaped-out stud. Particularly preferably, the orientation of the reinforcing fibers in the further stud also has a preferential direction. Thus, the stud strength of the two studs can advantageously be increased.

In a further preferred configuration, the stud and possibly the further stud is/are provided for fitting the lamp base in a lampholder. In particular, the lampholder can be in the form of a bayonet-type lampholder. The stud or the studs are then part of a bayonet-type closure.

The plastic base part preferably extends between an upper side and a lower side. Furthermore, the plastic base part preferably has a side face, which extends between the upper side and the lower side of the plastic base part. This side face is preferably formed, in regions, so as to be rotationally symmetrical with respect to an axis of the plastic base part, the axis passing in particular through the upper side and through the lower side of the plastic base part. In the case of a lamp with such a lamp base, the upper side of the plastic base part can face a lamp body provided for generating radiation. Correspondingly, the lower side of the plastic base part can face a lampholder, which is provided for fitting the lamp base. The axis of the plastic base part generally passes along a main direction of extent of the lamp.

The stud is preferably shaped out on the side face of the plastic base part, the stud in particular extending radially outwards. The stud can therefore cut through the rotational symmetry of the rotationally symmetrical region of the side face. The plastic base part with the stud is furthermore preferably formed in one piece.

The studs are preferably shaped out on the plastic base part in such a way that the studs extend pointing radially outwards, in particular diametrically. The preferential directions of the reinforcing fibers in the studs in this case run in colinear fashion.

Furthermore, the stud is preferably designed to be cylindrical, the cylinder axis of the stud particularly preferably running perpendicular to the axis of the plastic base part.

In a further configuration the stud has an end face. In particular, the end face can limit the physical expansion of the stud along a mid-axis of the stud. In the case of a cylindrically symmetrical stud, the mid-axis corresponds to the axis of cylindrical symmetry of the stud. Particularly preferably, the preferential direction of the orientation of the reinforcing fibers runs along the mid-axis of the stud.

The orientation of the reinforcing fibers in the stud in particular has a preferential direction when the angular distribution of the smallest angles between a predetermined straight line, which is oriented in any desired manner in three dimensions, and the respective main directions of extent of the individual reinforcing fibers deviates from a uniform distribution and has a maximum. The preferential direction accordingly runs along that straight line in which the maximum of the angle of distribution is an angle which is as small as possible. In contrast to this, in the case of reinforcing fibers with an isotropic distribution of the main directions of extent of the reinforcing fibers, all angles with respect to such a straight line would occur with the same degree of probability.

In a further preferred configuration, the orientation of the reinforcing fibers in the stud has a preferential axis, which particularly preferably runs in the preferential direction of the orientation of the reinforcing fibers in the stud. In particular, the preferential axis can pass through the end face of the stud. Furthermore, the preferential axis can run along the mid-axis of the stud or parallel to the mid-axis of the stud.

In a first preferred variant configuration, the reinforcing fibers have a profile parallel to the preferential axis or a profile which curves away from the preferential axis. In Particular, the reinforcing fibers which curve away from the preferential axis in the stud can have a hyperbolic profile. In this case, the profile of the reinforcing fibers towards the end face of the stud can asymptotically approach the preferential direction. Furthermore, the reinforcing fiber profile in the stud can be formed, at least in regions, in cylindrically symmetrical fashion with respect to the preferential axis.

In a second preferred variant configuration, the reinforcing fibers have a profile which curves towards the preferential axis. In particular, a spatial orientation distribution of the reinforcing fibers in the stud can be formed, at least in regions, in the manner of an ellipsoid of revolution with the preferential axis as the axis of rotational symmetry.

Given the described profiles of the reinforcing fibers, in particular given the two preferred variant configurations mentioned above, not all of the reinforcing fibers in the stud need to follow the respective profile. Instead, this can merely be regarded as a basic pattern of the reinforcing fiber profile which a predominant proportion of the reinforcing fibers within the stud follow. As a result of the alignment of the reinforcing fibers in accordance with one of these basic patterns, the stud strength can be increased in a simple manner.

In a particularly preferred configuration, in addition the further stud is formed in accordance with the first or the second preferred variant configuration mentioned above. In this way, the stud strength of the two studs can advantageously be increased. The studs can thus have an identical design as regards the stud strength. Even the event of a stud breaking can result in failure of the lamp during operation of a lamp with such a lamp base. The stud strength of the stud with the lower stud strength is therefore generally critical for the mechanical load-bearing capacity of the lamp base. A lamp base in which the two studs have a comparatively high stud strength is therefore characterized by a particularly high mechanical load-bearing capacity.

In particular, that force which needs to be applied to break off the stud from the plastic base part can be considered to be a measure of the stud strength.

In a preferred configuration, the lamp base has an additional bracing element for the stud or for the studs. For example, the bracing element can be formed by means of a metal sheet. The bracing element, for example the metal sheet, is preferably at least partially embedded in the plastics material of the plastic base part. A further increase in the resistance to breakage of the stud or the studs can be achieved by means of the additional bracing element. Such a bracing element is described in the German laid-open specification DE 10 2004 0252 68, whose disclosure content is to this extent incorporated by reference.

Particularly preferably, the additional bracing element for the stud is in the form of a tab, which is shaped out on an annular metal element. This annular metal element can also be used as the metal element for an electrical connection of the lamp.

The plastics material of the plastic base part preferably consists of a plastic which can be subjected to a high thermal load or contains at least one such plastic. For example, a plastic from the group consisting of polyetherimide (PEI), polyphenylenesulfide (PPS) and liquid crystal polymer (LCP) can be used.

LCP is characterized in particular by a particularly favorable gas evolution response. This means that during operation of a lamp with an LCP lamp base, comparatively little material is subject to gas evolution in comparison with other plastics and therefore a deposit of the material on the lamp, in particular on an optically active element of the lamp, for example a radiation penetration surface or a lens, can largely be reduced.

The reinforcing fibers are preferably in the form of glass fibers. Typically, the plastics material is mixed with glass fibers, the glass fiber content being between 20% and 70%, inclusive, preferably between 30% and 50%, inclusive. As an alternative, or in addition, other reinforcing fibers, for example carbon fibers, can also be used.

In a preferred configuration, the lamp base is in the form of a lamp base for a high-pressure discharge lamp. Since such lamps are started with high-voltage pulses, for example with pulses of 30 kV, a resistance to high voltages of the base is particularly important. The required resistance to high voltages is in particular achieved by means of a seal, which is formed on a lampholder which is provided for fitting such a lamp.

A comparatively high amount of force is required for pressing the lamp base against the seal, which requires a high stud strength, typically a resistance to breakage up to a force of 100 N or more. A lamp base with a plastic base part with reinforcing fibers, whose orientation in the stud has a preferential direction, is therefore particularly suitable for such high-pressure discharge lamps.

Particularly preferably, the lamp base is in the form of a lamp base for a vehicle lamp, in particular for a headlamp, for example a front headlamp, of a vehicle.

A method according to the invention for manufacturing a lamp base which has a plastic base part with at least one shaped-out stud comprises the following steps:

a) provision of a casting mold with a casting chamber, b) flowing-in of a molding compound, which contains a plastics material mixed with reinforcing fibers, via an inlet of the casting mold into the casting chamber, the molding compound flowing at least partially through a subchamber of the casting chamber of the casting mold, which subchamber is shaped for the formation of the stud, and c) finishing of the lamp base.

Owing to the fact that the plastics compound flows through the subchamber of the casting mold, which subchamber is shaped for the formation of the stud, the formation of a preferential direction of the orientation of the reinforcing fibers in the stud is required. Typically, the preferential direction of the orientation of the reinforcing fibers in the stud after step c) runs along the flow direction in which the molding compound flows through the subchamber of the casting chamber of the casting mold, which subchamber is shaped for the formation of the stud.

In a preferred configuration, the casting chamber has a further subchamber, which is shaped for the formation of the further stud, the molding compound at least partially flowing through this further subchamber in step b). Advantageously, the stud strength of the further stud can thus likewise be increased. The stud strength of the two studs can therefore assume approximately the same value. Since breakage of a stud already generally results in failure of a lamp with such a lamp base, an upper mechanical load limit above which the lamp fails can thus advantageously be increased.

In a preferred configuration, an additional bracing element for the stud is introduced into the casting chamber prior to step b), and the bracing element is at least partially encapsulated by the molding compound in step b). Owing to the additional bracing element, the stud strength can be increased further. Preferably, the lamp base for each stud has in each case one additional bracing element. Particularly preferably, the additional bracing elements are connected integrally to one another. This simplifies the arrangement of the additional bracing elements in the casting mold. Alternatively, each stud can have a separate additional bracing element. In both cases, the stud strength of the two studs can advantageously be increased.

In a preferred configuration, a sprue part is formed on the stud in step b). A sprue part is in particular understood to mean a part which is formed by means of the molding compound for the plastic base part and protrudes beyond the plastic base part to be formed. The sprue part is typically produced at the inlet of the casting mold.

In order to produce the plastic base part, the sprue part can be severed from the stud in step c) after curing of the molding compound. A separation point is produced on the stud, in particular on an end face of the stud, as a result of the severing process. A preferential axis of a spatial orientation of the reinforcing fibers in the stud preferably passes through this separation point.

Furthermore, a further sprue part can be formed on the further stud, which further sprue part is likewise severed from the further stud in step c). In this case, the casting mold preferably has a further inlet, through which the molding compound can flow into the casting chamber in step b). Thus, some of the molding compound can flow through the two subchambers provided for the formation of the studs in step b). The orientation of the reinforcing fibers in the two studs along a preferential direction is assisted thereby, which advantageously makes it possible to increase the stud strength.

In a further preferred configuration, an overflow part is formed in step b) by means of a proportion of the molding compound which flows through the subchamber of the casting chamber of the casting mold, which subchamber is shaped for the formation of the stud. For this purpose, the casting chamber of the casting mold has an overflow subchamber, which is shaped for the formation of the overflow part. After step b), the overflow part protrudes beyond the plastic base part to be produced and adjoins the stud. In step c), the overflow part can be severed from the plastic base part to be produced. Owing to the molding compound flowing through the subchamber of the casting chamber, which subchamber is shaped for the formation of the stud, an orientation of the reinforcing fibers which has a preferential direction is assisted. The stud strength can thus advantageously be increased.

Furthermore, a further overflow part can be formed in step b) by means of a proportion of the molding compound which flows through the further subchamber of the casting chamber of the casting mold, which further subchamber is shaped for the formation of the further stud. For the formation of the further overflow part, the casting mold has a further overflow subchamber for this purpose. As a result, the two studs can be formed identically in terms of the orientation of the reinforcing fibers in the studs. The stud strengths of the two studs can thus advantageously be matched to one another.

In a particularly preferred configuration, a sprue part is formed on the stud and an overflow part is formed on the further stud. The sprue part and the overflow part can be severed in step c). In this configuration, too, in each case a proportion of the molding compound flows through the two subchambers shaped for the formation of the studs. An orientation of the reinforcing fibers in the studs with a preferential direction is thus assisted, as a result of which the stud strength of the two studs can advantageously be increased.

In a further preferred configuration, the molding compound flows in by means of casting, in particular by means of injection molding, in step b). The plastic base part can in particular be in the form of an injection-molded part.

Figure 1B:
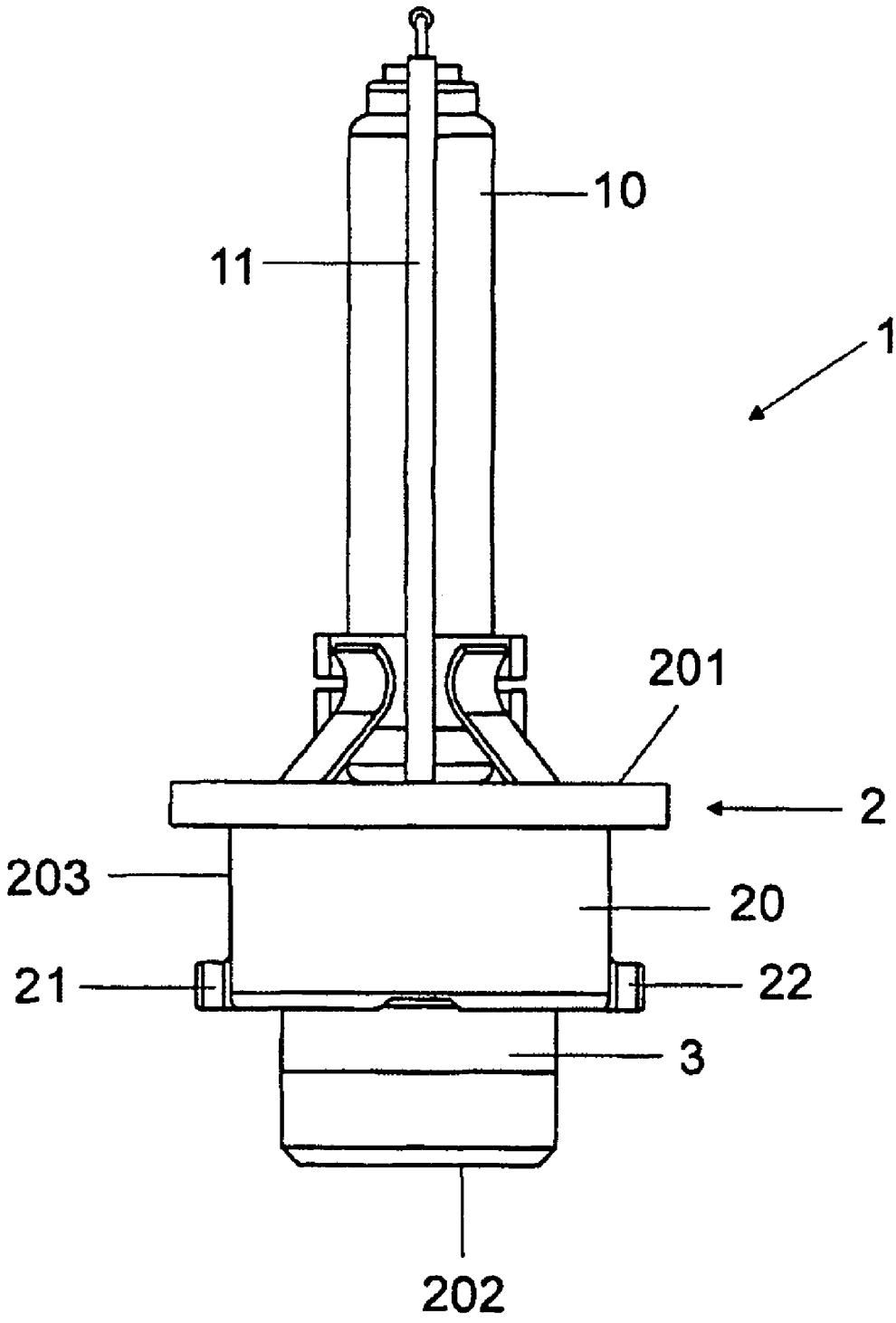
Figure 2A:
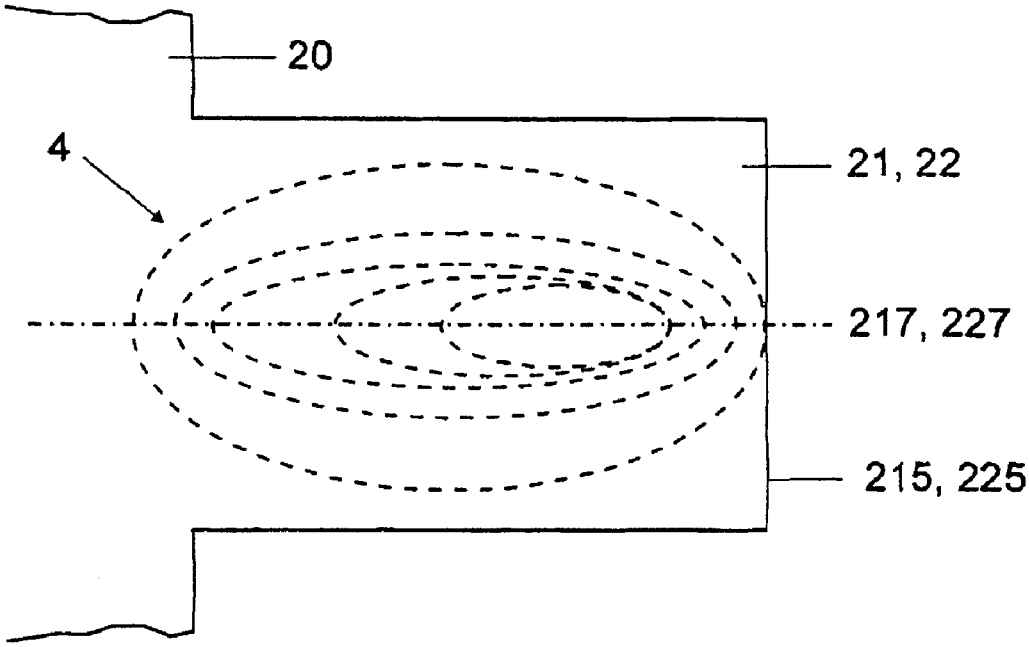
Figure 2B:
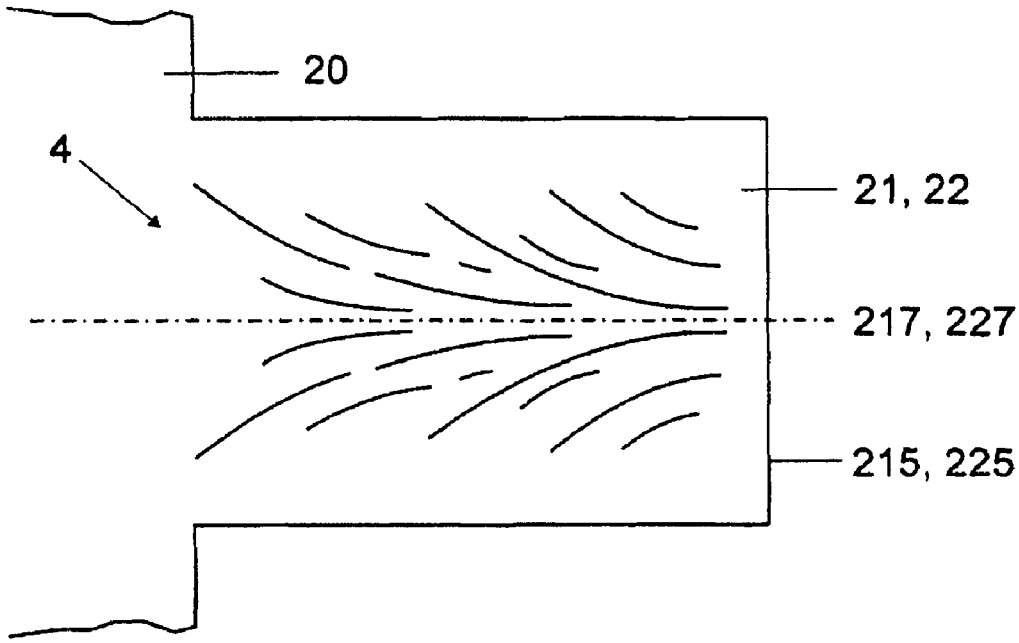
Figure 3A:
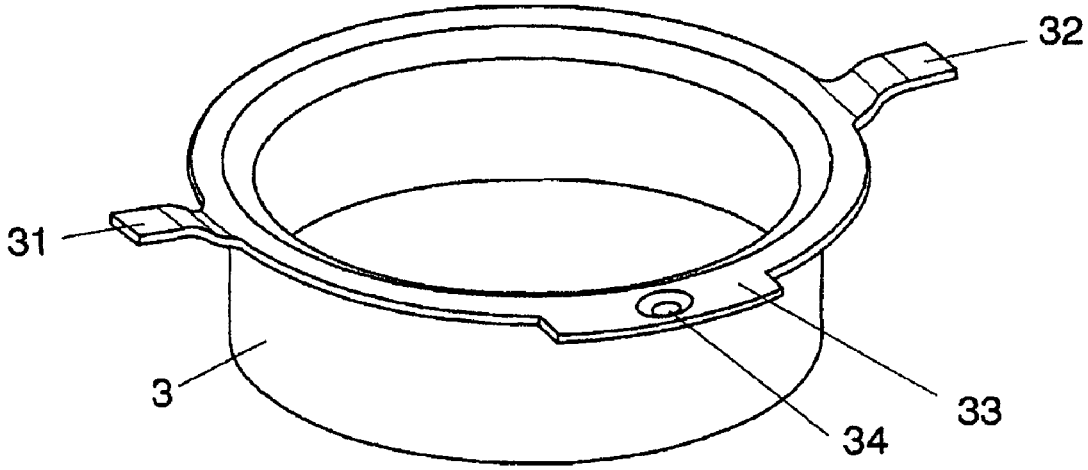
Figure 3B:
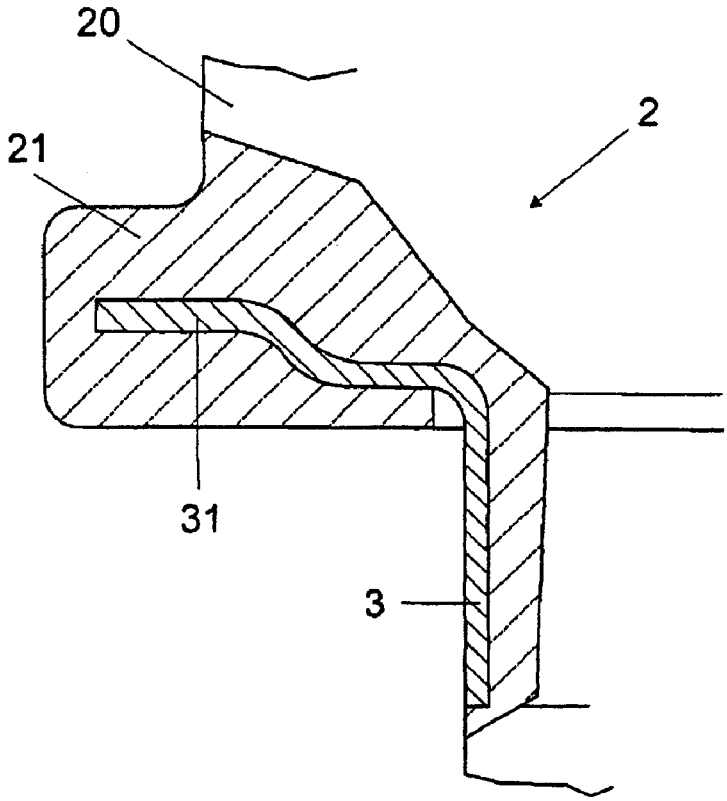
Figure 4A:
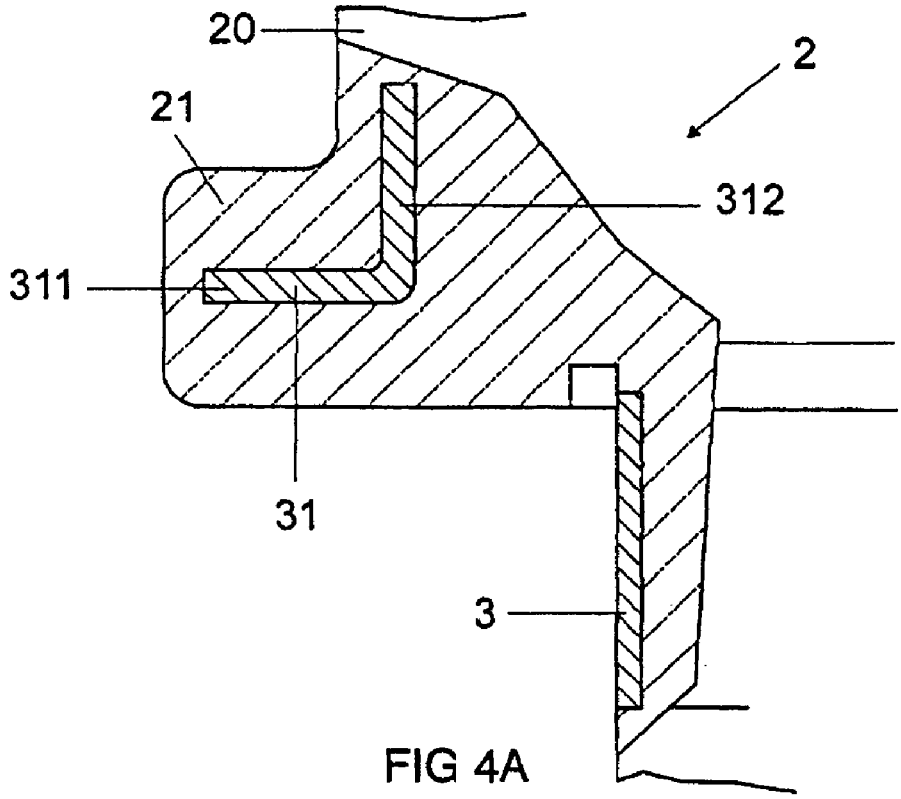
Figure 4B:
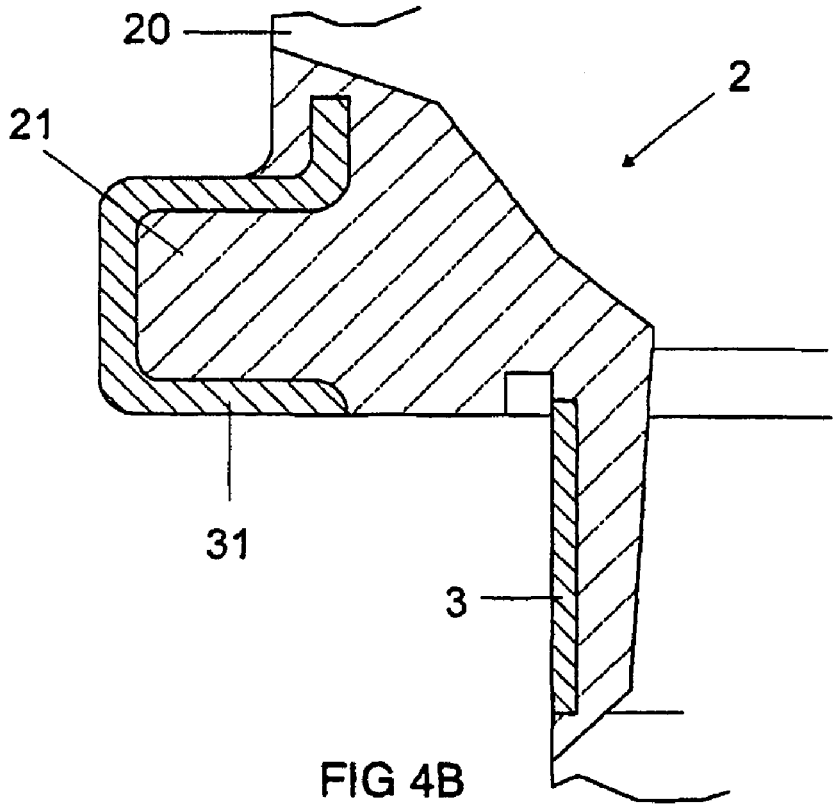
Figure 5A:
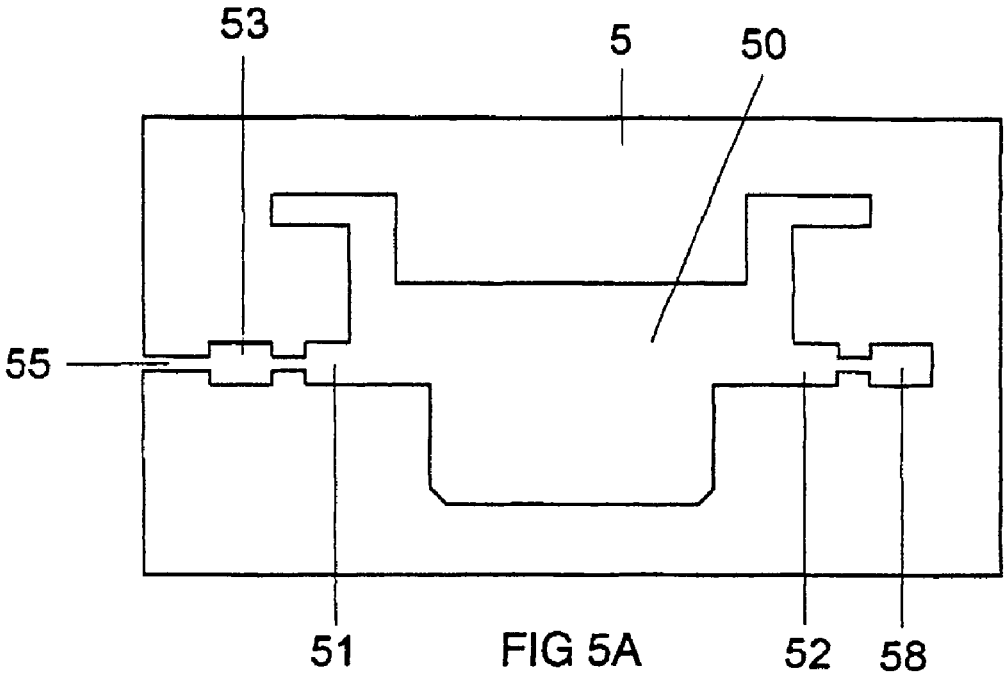
Figure 5B:
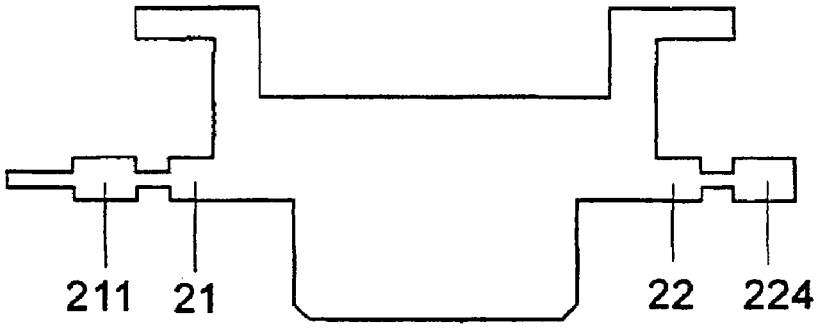
Figure 5C:
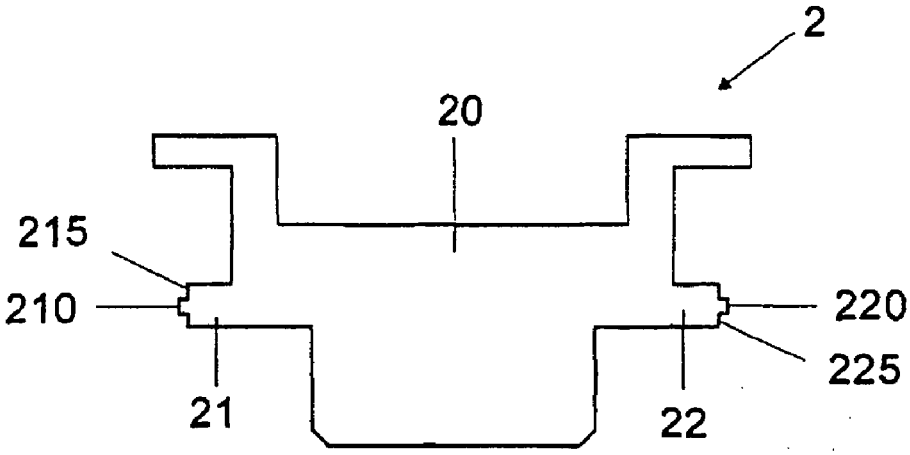
Figure 6A:
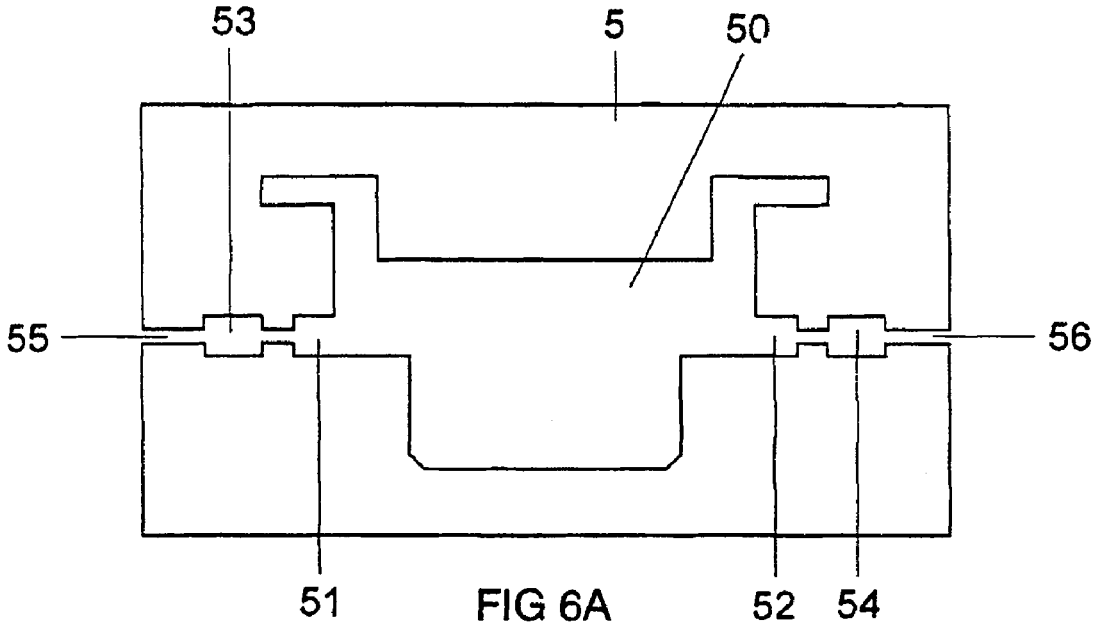
Figure 6B:
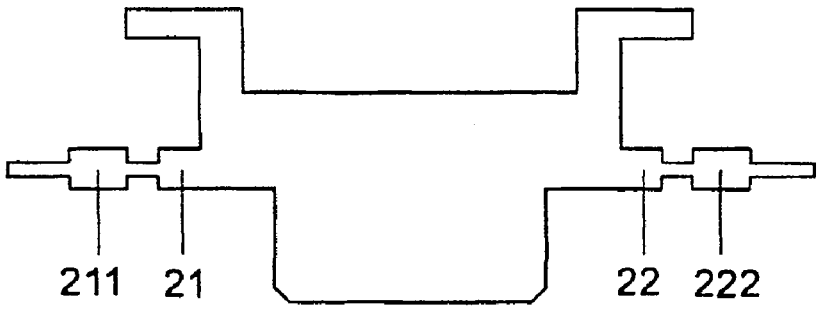
Figure 6C:
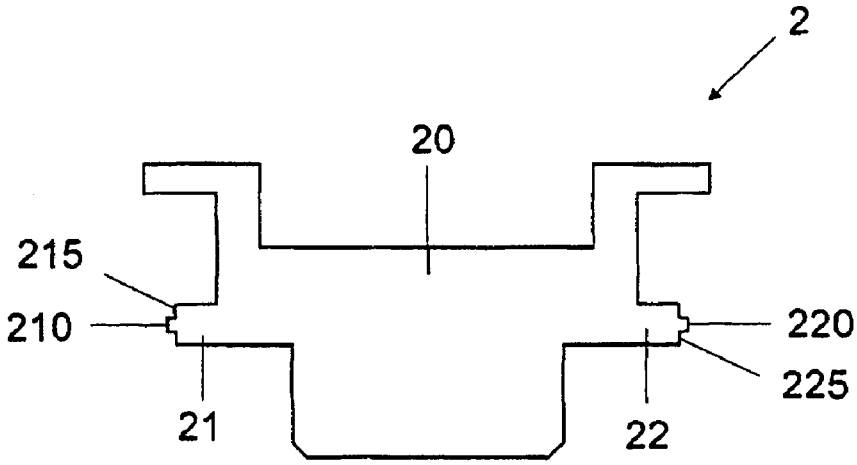
Figure 7A:
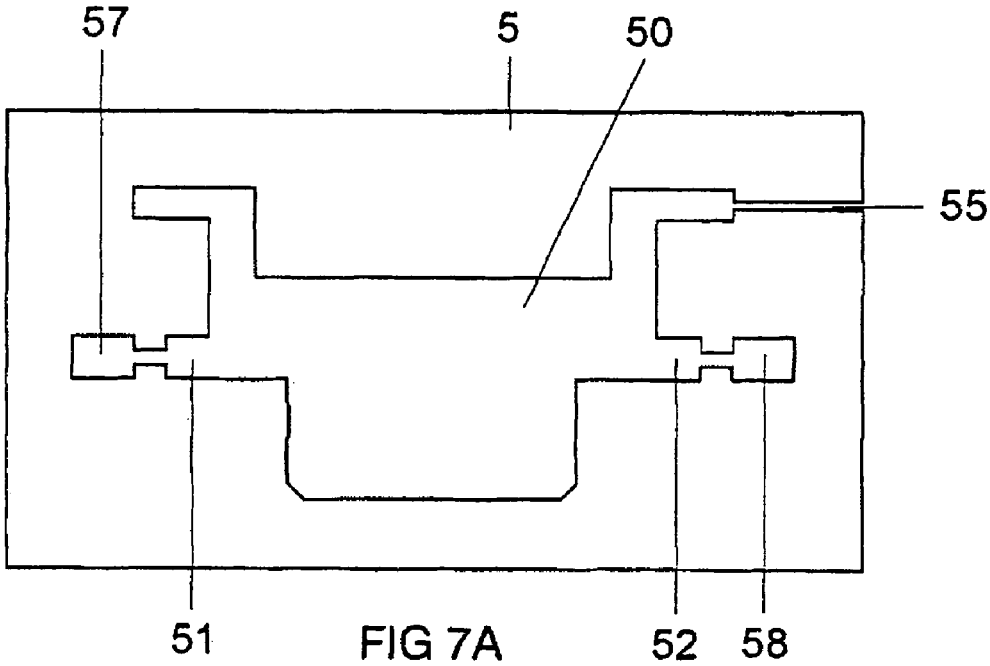
Figure 7B:
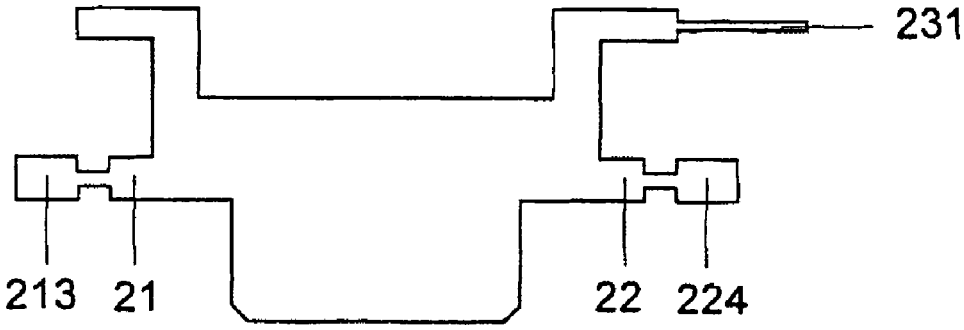
Figure 7C:
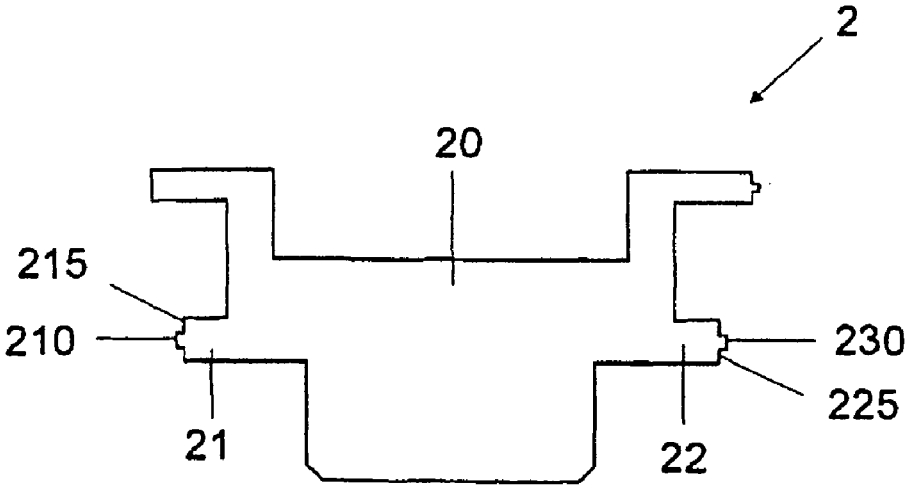

Further features, advantageous configurations and expedient embodiments of the invention result from the description below relating to the exemplary embodiments in conjunction with the figures, in which:

FIG. 1A shows an exemplary embodiment of a lamp with a lamp base according to the invention using a schematic perspective illustration, and FIG. 1B shows a schematic plan view of the lamp, FIGS. 2A and 2B each show an exemplary embodiment of the orientation of the reinforcing fibers in a stud using a schematic sectional view through the stud, FIG. 3A shows a schematic illustration of an exemplary embodiment of an additional bracing element and FIG. 3B shows a schematic sectional view through a lamp base according to the invention in the region of the stud with an additional bracing element as shown in FIG. 3A, FIGS. 4A and 4B show schematic views in each case of a further exemplary embodiment of a lamp base according to the invention with an additional bracing element, FIGS. 5A to 5C show a first exemplary embodiment of a method according to the invention using intermediate steps illustrated schematically, FIGS. 6A to 6C show a second exemplary embodiment of a method according to the invention using intermediate steps illustrated schematically, and FIGS. 7A to 7C show a third exemplary embodiment of a method according to the invention using intermediate steps illustrated schematically.

Identical, similar and functionally identical elements have been provided with the same reference symbols in the figures.

FIG. 1A shows, schematically, a perspective illustration of a lamp 1 with a lamp base 2 according to the invention. A plan view of this lamp is illustrated in FIG. 1B. The lamp base is configured by way of example in such a way that it meets the international standard IEC 60061-1 for a so-called P32d base.

The lamp shown is a high-pressure discharge lamp, in particular a metal-halide high-pressure discharge lamp with an electrical power consumption of approximately 35 W, which is intended for use in a motor vehicle front headlamp.

A discharge vessel (not illustrated in the figure) is arranged in a transparent, cylindrical protective bulb 10. Two gas discharge electrodes and a xenon- and metal-halide-comprising ionizable fill for producing a gas discharge are provided in the interior of the discharge vessel. Individual features of the discharge vessel, the protective bulb 10 and the manner in which the latter is fixed in the lamp base are described in more detail by way of example in the abovementioned European laid-open specification EP 0 786 791 A1.

The lamp base 2 has a plastic base part 20, on which a stud 21 and a further stud 22 are shaped out. The plastic base part 20 with the studs 21 and 22 is designed to be in one piece. The plastic base part extends between an upper side 201 and a lower side 202. A side face 203 extends between the upper side and the lower side and is formed, in regions, to be cylindrical-symmetrical with respect to an axis of the plastic base part 20, the axis passing through the upper side and the lower side. Furthermore, the axis runs along the main direction of extent of the lamp 1.

Furthermore, the lamp base 2 has an annular metal element 3. This annular metal element is used for making electrical contact with the lamp 1. In particular, the annular metal element is electrically conductively connected to a power return line element 11.

The studs 21 and 22 are formed so as to point radially outwards and are in particular arranged diametrically with respect to one another. The studs are used for fastening the lamp base 2 in a lampholder, in particular a bayonet-type lampholder.

The orientation of the reinforcing fibers in the studs 21 and 22 in each case has a preferential direction. The reinforcing fiber profile will be explained in more detail in connection with FIGS. 2A and 2B.

FIG. 2A shows, schematically, a section through the stud 21 or 22, a mid-axis 217 of the stud 21 or a mid-axis 227 of the further stud 22 lying in the section plane.

The studs 21 and 22 are designed to be cylindrical-symmetrical with respect to the mid-axis 217 and 227, respectively. In particular, the mid-axes of the studs in each case extend perpendicular to the axis of the plastic base part. The spatial expansion of the studs 21 and 22 in the direction of the mid-axis is in each case limited by an end face 215 and 225, respectively.

In FIG. 2A, the orientation of the reinforcing fibers 4 of the stud 21 has a preferential axis, which has a profile congruent with the mid-axis 217 of the stud. The preferential axis extends in the preferential direction of the orientation of the reinforcing fibers. A congruent profile of the preferential axis with the mid-axis 217 is preferred since, in this case, the orientation of the reinforcing fibers in the stud 21 can be formed particularly well so as to be rotationally symmetrical with respect to the preferential axis. As a deviation from this, the preferential axis can also have a profile parallel or at an angle to the mid-axis 217, however.

In FIG. 2A, the reinforcing fibers 4 in the stud 21 have a profile which curves towards the preferential axis. In particular, the spatial orientation distribution of the reinforcing fibers 4 in the stud 21 is formed in the manner of an ellipsoid of revolution. The figure shows, in order to illustrate the fiber profile, a section through five ellipsoids of revolution, with the reinforcing fibers preferably extending along the surface thereof. The axes of rotational symmetry of these ellipsoids of revolution run colinearly along the preferential axis, which is formed by the mid-axis 217.

In particular, the shape of the ellipsoids of revolution is at least partially different than a spherical shape, with the result that the spatial orientation distribution of the reinforcing fibers in the stud 21 has a preferential direction along the mid-axis 217. The frequency with which, in the section through the stud shown, angles arise between the mid-axis and the respective main direction of extent of the individual reinforcing fibers increases towards small angles. Using a section through the stud, the preferential direction of the spatial orientation distribution can thus be determined.

An alternative orientation of the reinforcing fibers with a preferential direction is illustrated in FIG. 2B. The reinforcing fibers 4 have a profile parallel to the preferential axis or a profile which curves away from the preferential axis. In particular, the reinforcing fibers 4 which curve away from the preferential axis in the stud 21 have a hyperbolic profile, the profile of the reinforcing fibers towards the end face 215 of the stud asymptotically approaching the preferential direction. The preferred profile of the reinforcing fibers is in turn formed so as to be rotationally symmetrical with respect to the preferential axis and therefore with respect to the mid-axis 217.

The profile sketched in each case in FIGS. 2A and 2B is merely intended to represent how the reinforcing fibers 4 are preferably aligned in the stud 21. This does not mean that all of the reinforcing fibers in the stud are formed in accordance with this basic pattern of the fiber profile. Likewise, the details as regards symmetry relate to this basic pattern. The actual profile of the individual reinforcing fibers is generally not precisely rotationally symmetrical.

The orientation of the reinforcing fibers in the studs shown in FIGS. 2A and 2B has in each case one preferential direction, the preferential direction running in particular along the mid-axis of the respective stud. In both cases, the stud strength can thus advantageously be increased.

Of course it is also possible for the fiber profile in the further stud 22 to have the configuration as described in connection with FIG. 2A or 2B. In this case, the preferential axis of the orientation of the reinforcing fibers 4 runs along the mid-axis 227 of the further stud 22.

Particularly preferably, the studs 21 and 22 each have one of the orientation distributions shown. Thus, the stud strength of the two studs can advantageously be increased simultaneously.

FIG. 3B shows an exemplary embodiment of a lamp base, in which the lamp base has an additional bracing element 31 for the stud 21. In this case, FIG. 3B shows, schematically, a section through the stud 21. The bracing element 31 is in the form of a tab, which is shaped out on the annular metal element 3. Furthermore, the reinforcing element is embedded in the plastics material of the lamp base 20.

The annular metal element is shown schematically in FIG. 3A in a perspective illustration. The annular metal element 3 has two tabs 31 and 32, which are arranged diametrically with respect to one another and have a profile pointing radially outwards. In this case, the tab 31 is provided for additionally bracing the stud 21 and the tab 32 is provided for additionally bracing the stud 22. Furthermore, a welding lug 33, which is bent back in the radial direction, is formed on the annular metal element 3. The welding lug has a cutout 34, which is used for making electrical contact with the power supply wire of the power return line 11.

The additional bracing element 31 can also be formed separately from the annular metal element. In this regard, FIGS. 4A and 4B show two exemplary embodiments, with it being possible for the bracing element to in each case be in the form of a metal sheet. In FIG. 4A, the bracing element is substantially annular and has a first limb 311 and a second limb 312. In the exemplary embodiment shown in FIG. 4B, the bracing element 31 is substantially in the form of a U and covers the majority of an outer surface of the stud 21.

The exemplary embodiments shown in FIGS. 3A to 4B of the bracing element or of the annular metal element are described in more detail in the German laid-open specification DE 10 2004 0252 68 mentioned above.

In the exemplary embodiments shown in FIGS. 1 to 4, the plastic base part 20 and the studs 21 and 22 shaped out thereon preferably consist of a plastic which can be subjected to a high thermal load or at least contain such a plastic. Furthermore, the plastic can preferably be subjected to a high mechanical load. For example, a plastic from the group consisting of polyetherimide (PEI), polyphenylenesulfite (PPS) and liquid crystal polymer (LCP) can be used. A polyetherimide, which is also known under the trade name ULTEM®, typically has a glass fiber content of 30%. Polyetherimide can be used to form studs which already have a strength of more than 500 N, without any additional bracing element. The elongation at break of this material is 2%.

In the case of the liquid crystal polymer (LCP), which is also known under the trade name VECTRA® or ZENITE®, the proportion of glass fibers in the material is between 30% and 50%, inclusive. LCP is characterized in particular in terms of the gas evolution response by a particularly high aging stability. In comparison with other plastics which can be subjected to high thermal loads, LCP therefore makes it possible to manufacture a lamp in which fogging of optical components, for example of the protective bulb 10, as a result of the evolution of gas from the plastic base part 20 is largely reduced. LCP is a highly anisotropic, highly crystalline material, which can form crystalline regions as early as in the liquid phase, with the result that, by means of suitable alignment of the crystals during manufacture of the plastic base part, for example by means of casting or spraying, it is possible to achieve an improvement in the stud strength. The reinforcing fibers can, for example, also be in the form of carbon fibers, as an alternative to or in addition to glass fibers.

FIGS. 5*a* to 5*c* show a first exemplary embodiment of a method according to the invention for manufacturing a lamp base 2 using a schematic illustration of intermediate steps. These figures illustrate, by way of example, a method for a lamp base with in each case two studs 21 and 22. FIG. 5A shows, schematically, a section through a casting mold 5, which is provided for manufacturing the lamp base 2 and has a casting chamber 50. In this case, the section runs diametrically through the casting chamber 50, with the result that the subchambers 51 and 52, which are provided for the formation of the radially outwardly pointing, and in particular diametrically arranged studs 21 and 22, respectively, can be seen in the section.

A part which is provided in a finished lamp base 2 and is provided, for example, for making electrical contact with the lamp 1 or as an additional bracing element, can be arranged in the casting chamber 50 before the casting compound flows in. This is not illustrated explicitly in FIGS. 5A to 7C, for reasons of improved clarity. The molding compound can thus flow at least partially around this part. In particular, an additional bracing element 31 for the stud 21 and/or for the stud 22, for example a bracing element, which is configured as described in connection with FIGS. 3A to 4B, can be arranged in the casting chamber.

In the exemplary embodiment shown in FIG. 5A, the casting chamber has an overflow subchamber 58 and a sprue subchamber 53. The sprue subchamber adjoins an inlet 55 of the casting mold 5. In order to manufacture the lamp base, the casting chamber is filled with a molding compound via the inlet. Said molding compound can flow in, for example, by means of casting, for example injection molding.

The molding compound, which is provided for forming the plastic base part, is let into the casting chamber 50 of the casting mold 5 through the inlet 55 in the castable state. In this case, the casting compound flows through the subchamber 51 shaped for the formation of the stud 21. Furthermore, some of the molding compound flows through the subchamber 52 shaped for the formation of the further stud 22, with the result that an overflow subchamber 58 is filled with the molding compound. At least some of the molding compound therefore flows through both of the cavities 51 and 52 provided for the shaping of the studs 21 and 22, respectively. As a result of the fact that the molding compound flows through the two studs 21 and 22, an orientation of the reinforcing fibers which has a preferential direction is assisted. The preferential direction runs along the direction in which the molding compound flows through the respective subchambers 51 and 52.

Once the molding compound has solidified, the plastic base part 20 illustrated schematically in FIG. 5B with the sprue part 211 and the overflow part 244 can be removed from the casting mold 5. The sprue part 211 and the overflow part 224 extend radially outwards from the respective studs 21 and 22.

In a subsequent step, the sprue part 211 and the overflow part 224 are severed from the studs 21 and 22, respectively. The severing process is preferably carried out mechanically, for example by means of breaking, cutting or sawing. The finished lamp base 2 with the plastic base part 20 is illustrated in FIG. 5C.

The spatial orientation distribution of the reinforcing fibers in the stud 21 can be configured as described in connection with FIG. 2A. Such an orientation distribution of the reinforcing fibers is typical for a stud in which the subchamber 51 of the casting chamber 50 of the casting mold 5, which subchamber is provided for the shaping of the stud, adjoins the sprue subchamber 51.

The orientation distribution of the reinforcing fibers in the further stud 22 can be formed in accordance with the orientation distribution described in connection with FIG. 2B. Such an orientation distribution is typically achieved by virtue of the fact that some of the molding compound flows through the casting chamber 52 which is provided for the formation of the stud 22 adjoining the overflow part as the molding compound flows in, the overflow subchamber 58 being filled. In this case, in comparison with a stud in which the subchamber shaped for the formation of the stud does not adjoin an overflow subchamber during manufacture, the formation of an orientation of the reinforcing fibers with a preferential direction is assisted. The stud strength can thus advantageously be increased.

In the case of measurements of the force with which the studs are broken away from the plastic base 20, which force acts along the axis of the lamp base, on average a value which was approximately 20% to 30% higher than in the case of comparison lamp bases in which no overflow part was formed on the further stud during manufacture resulted for lamp bases manufactured in accordance with the method described in connection with FIG. 5. In contrast to the casting mold 5 shown in FIG. 5A, therefore, there is no overflow subchamber adjoining the subchamber shaped for the formation of the further stud of the comparison lamp base. It is therefore not possible for the molding compound to flow through the subchamber provided for the formation of the further stud during manufacture of the comparison lamp base. An orientation of the reinforcing fibers in the further stud of the comparison lamp base along a defined flow direction is thus prevented. This means that there is no significant preferential direction for the orientation of the reinforcing fibers in the further stud of the comparison lamp base.

Correspondingly, it has been shown in the case of the comparison lamp bases that first the further stud, the one which is not equipped with a preferential direction of the reinforcing fibers, usually breaks off. Accordingly, in the comparison lamp bases the further stud is weaker than the stud through which the molding compound flows as it flows in through the inlet. Accordingly, by means of the targeted alignment of the reinforcing fibers in the stud along the preferential direction it is advantageously possible to increase the mechanical load-bearing capacity of the studs.

In the case of measurements using lamp bases with additional bracing elements 31 and 32, which are configured and arranged as described in connection with FIGS. 3A and 3B, for the studs 21 and 22, respectively, the stud strength could be increased to a greater extent from approximately 380 N to an average value of over 500 N. An additional bracing element therefore makes it possible advantageously to further increase the mechanical load-bearing capacity of the studs.

The measured values specified in each case relate to lamp bases 2 in which the plastic base part 20 is formed by means of LCP material with glass fibers as reinforcing fibers.

In the finished lamp base 2, the studs 21 and 22 each have a separation point 210 and 220, respectively. These separation points are produced when the overflow part 224 and the sprue part 211, respectively, are severed. The preferential axes of the orientation of the reinforcing fibers in the studs 21 and 22 pass through these separation points 210 and 220, respectively.

In the second exemplary embodiment of a method according to the invention shown in FIGS. 6A to 6C using intermediate steps, the casting mold 5 differs from the casting mold 5 shown in FIG. 5A in that the casting mold has a further inlet 56 in addition to the inlet 55. In this case, a sprue subchamber 53 is formed at the inlet 55 and a sprue subchamber 54 is formed at the further inlet 56. These two sprue subchambers 53 and 54 in each case adjoin a subchamber 51, which is shaped for the formation of the first stud, and, respectively, a further subchamber 52, which is shaped for the formation of the further stud. In this exemplary embodiment, the molding compound can thus flow into the casting chamber 50 of the casting mold 5 through the inlet 55 and the further inlet 56. FIG. 6B again shows the plastic base part 20 with the stud 21 and the further stud 22 and an overflow part 211 adjoining the stud and an overflow part 222 adjoining the further stud 22.

FIG. 6C again shows the finished lamp base 2 with the plastic base part 20 once the sprue part 211 and the further sprue part 222 have been severed. During this severing process, again a separation point 210 is formed at the stud 21 and a separation point 220 is formed at the further stud 22.

The reinforcing fibers in the stud 21 and the further stud each have a spatial orientation distribution with a preferential direction, which can be formed as described in connection with FIG. 2A. In both studs, the orientation of the reinforcing fibers therefore has a preferential direction, as a result of which the stud strengths of the two studs can advantageously be matched to one another.

In the third exemplary embodiment of a method according to the invention, which is shown with reference to a schematic illustration of intermediate steps in FIGS. 7A to 7C, the casting mold 5 shown in FIG. 7A differs from the casting mold shown in FIG. 5A in that an overflow subchamber 57 adjoins the subchamber 51 shaped for the formation of the first stud 21. When the molding compound flows into the casting chamber 50 through the inlet 55, in each case some of the molding compound flows through the subchamber 51, which is shaped for the formation of the stud 21, and the subchamber 52, which is shaped for the formation of the further stud 22, with the result that the overflow subchambers 57 and 58, which adjoin said subchambers, are filled with molding compound.

FIG. 7B again shows the plastic base part 20 with an overflow part 213 and a further overflow part 224, the overflow part 213 adjoining the stud 21 and the overflow part 224 adjoining the stud 22. Furthermore, a sprue part 231 is formed on the plastic base part 20.

FIG. 7C shows the finished lamp base 2 with a plastic base part 20, in which the overflow part 213 and the further overflow part 224 and the sprue part 231 have been removed. Correspondingly, the plastic base body has three separation points 210, 220 and 230.

The spatial orientation distribution of the reinforcing fibers in the stud 21 and the further stud 22 has a preferential direction and can in particular be configured in accordance with the spatial orientation distribution described in connection with FIG. 2B. In this exemplary embodiment of the method, too, the finished lamp base therefore has two studs, in which the spatial orientation of the reinforcing fibers in each case has a preferential direction. The profiles of the reinforcing fibers in the studs 21 and 22 therefore have the same basic pattern. Advantageously, the studs 21 and 22 can thus have a stud strength which is approximately the same.

Naturally, the invention is also suitable for manufacturing lamp bases with a number of studs which is different than two, for example with one stud or with three studs.

The invention is not restricted by the description with reference to the exemplary embodiments. Instead, the invention includes any novel feature and any combination of features which in particular includes any combination of features in the patent claims, even if this feature or this combination itself is not explicitly specified in the patent claims or the exemplary embodiments.

The invention claimed is:

1. A lamp base (2), which has a plastic base part (20) with at least one shaped-out stud (21), the plastics material of the plastic base part being mixed with reinforcing fibers (4), whose orientation in the stud has a preferential direction; wherein the orientation of the reinforcing fibers (4) in the stud (21) in the preferential direction has a preferential axis, the preferential axis passing through an end face (215) of the stud (21) in which the reinforcing fibers (4) in the stud (21) have a profile parallel to the preferential axis or a profile which curves away from the preferential axis; and the reinforcing fibers which curve away from the preferential axis have a hyperbolic profile, and the profile of the reinforcing fibers towards the end face (215) asymptotically approaches the preferential direction.

2. The lamp base as claimed in claim 1, in which the reinforcing fibers (4) in the stud (21) have a profile which curves towards the preferential axis.

3. A lamp base (2), which has a plastic base part (20) with at least one shaped-out stud (21), the plastics material of the plastic base part being mixed with reinforcing fibers (4), whose orientation in the stud has a preferential direction; wherein the orientation of the reinforcing fibers (4) in the stud (21) in the preferential direction has a preferential axis, the preferential axis passing through an end face (215) of the stud (21) in which the reinforcing fibers (4) in the stud (21) have a profile which curves towards the preferential axis; and a spatial orientation distribution of the reinforcing fibers (4) in the stud (21) is formed, at least in regions, as an ellipsoid of revolution with the preferential axis as the axis of rotational symmetry.

4. A lamp base (2), which has a plastic base part (20) with at least one shaped-out stud (21), the plastics material of the plastic base part being mixed with reinforcing fibers (4), whose orientation in the stud has a preferential direction; wherein the orientation of the reinforcing fibers (4) in the stud (21) in the preferential direction has a preferential axis, the preferential axis passing through an end face (215) of the stud (21) in which the orientation of the reinforcing fibers (4) in a further stud (22) in a further preferential direction has a further preferential axis, the further preferential axis passing through a further end face (225) of the further stud (22);

in which the reinforcing fibers (4) in the further stud have a profile parallel to the further preferential axis or a profile which curves away from the further preferential axis; and the reinforcing fibers which curve away from the further preferential axis have a hyperbolic profile, and the profile of the reinforcing fibers towards the further end face (225) asymptotically approaches the preferential direction.

5. A lamp base (2), which has a plastic base part (20) with at least one shaped-out stud (21), the plastics material of the plastic base part being mixed with reinforcing fibers (4), whose orientation in the stud has a preferential direction;

the orientation of the reinforcing fibers (4) in the stud (21) in the preferential direction has a preferential axis, the preferential axis passing through an end face (215) of the stud (21) in which the orientation of the reinforcing fibers (4) in a further stud (22) in a further preferential direction has a further preferential axis, the further preferential axis passing through a further end face (225) of the stud (22) in which the reinforcing fibers (4) in the further stud (22) have a profile which curves towards the further preferential axis; and a spatial orientation distribution of the reinforcing fibers (4) in the further stud (22) is formed, at least in regions, in the manner of an ellipsoid of revolution with the further preferential axis as the axis of rotational symmetry.

6. The lamp base as claimed in claim 4 or 5, in which the reinforcing fibers (4) are in the form of glass fibers or carbon fibers.

7. The lamp base as claimed in claim 4, in which the further stud (22) has a further separation point (220).

8. A lamp (1), which comprises a lamp base (2) as claimed in claim 1, 3, 4 or 5.

9. The lamp as claimed in claim 8, the lamp being in the form of a vehicle lamp.

* * * * *